US005102266A

United States Patent [19]

Carruba

[11] Patent Number: 5,102,266

[45] Date of Patent: Apr. 7, 1992

[54] OFFSHORE SUPPORT STRUCTURE

[75] Inventor: Samuel C. Carruba, Fulshear, Tex.

[73] Assignee: CBS Engineering, Inc., Houston, Tex.

[21] Appl. No.: 579,605

[22] Filed: Sep. 10, 1990

[51] Int. Cl.[5] ..... E02B 17/02

[52] U.S. Cl. ..... 405/227; 405/224; 405/195.1

[58] Field of Search ..... 405/227, 203, 208, 204, 405/195, 205, 207; 52/DIG. 10

[56] References Cited

U.S. PATENT DOCUMENTS

| | | | |
|---|---|---|---|
| 2,352,370 | 6/1944 | Carruthers . | |
| 3,094,847 | 6/1963 | Pogonowski . | |
| 3,501,919 | 3/1970 | Marshall | 405/227 |
| 3,729,940 | 5/1973 | Koehler | 405/227 X |
| 3,736,756 | 6/1973 | Lloyd . | |
| 4,007,598 | 2/1977 | Tax . | |
| 4,492,700 | 1/1985 | Horton | 166/358 |
| 4,534,678 | 8/1985 | Nakazato | 405/204 |
| 4,701,075 | 10/1987 | Martyshenko et al. | 405/217 |
| 4,705,430 | 11/1987 | Will | 405/227 |
| 4,818,145 | 4/1989 | Carruba | 405/203 |
| 4,842,446 | 6/1989 | Carruba | 405/227 |
| 4,909,672 | 3/1990 | Hancock | 405/227 |
| 4,917,541 | 4/1990 | Carruba | 405/227 |

OTHER PUBLICATIONS

Brochure, "Moss Concepts—Minimum Offshore Support Structures"; CBS Engineering, Inc.

*Primary Examiner*—Dennis L. Taylor

*Attorney, Agent, or Firm*—Ben D. Tobor

[57] ABSTRACT

An offshore support structure utilizes a central support structure having at least three substantially parallel tubular legs, and at least two outrigger support structures associated with the base of the central support structure.

10 Claims, 6 Drawing Sheets

OFFSHORE SUPPORT STRUCTURE

FIELD OF THE INVENTION

The invention relates to offshore support structures for use with at least one well located in a body of water.

DESCRIPTION OF THE PRIOR ART

In the drilling of wells at offshore locations, many offshore structures have been provided which have platform structures mounted thereon to support various types of drilling units. Many of these offshore structures are exceedingly large, massive, and expensive. It is thus desirable to reduce the costs of offshore support structures, so that the cost of placing a well in production is minimized, particularly in water depths of from 300 to 600 feet of water.

One common design of offshore support structure for use in water depths of from 300 to 600 feet of water utilizes four interconnected and braced legs which legs extend from the surface beneath the body of water, to above the surface of the water. The four legs are "battered", or sloped, whereby the cross-sectional configuration of the platform structure at the top of the offshore support structure is smaller than the cross-sectional configuration of the offshore support structure at the base of the support structure near the surface beneath the body of water. Typically a single pile extends through each leg from the top of the offshore support structure, to the surface beneath the body of water, in order to anchor and secure the offshore support structure against wave loads. There are many disadvantages associated with the foregoing described structure.

Construction and assembly of the previously described offshore support structure is difficult and expensive because of the sloping configuration of the legs. From the top of the offshore support structure to its bottom, the angular dispositions, and lengths of the bracing members, all change due to the sloping, or battered, legs of the support structure. Accordingly, none of the braces are of the same size, but rather vary depending upon where along the longitudinal axis of the offshore support structure, such braces are to be located. Likewise, because of the sloping legs, the angular dispositions of the braces with respect to the legs and other support members varies depending upon the vertical location of that particular component along the longitudinal axis of the support structure. Accordingly, set up and assembly time is increased, which increases the cost of the structure. Because of the necessity of utilizing a long pile through each of the sloping legs to secure the structure to the surface beneath the body of water, there are substantial costs associated with such long piles, which costs can be from one half million to two million dollars depending upon the height of the offshore structure.

Another disadvantage associated with such prior art offshore support structures is that because of the large, massive size of such structures, including the substantial size of the upper portion of such structures which is exposed to increased wave loads from wave pressure forces acting upon the larger surface area of the offshore support structure, the piling requirements for such structure are increased. Additionally, the amount of steel and the size of structural components used in such structures are increased in order to be able to withstand such increased wave loads.

Accordingly, prior to the development of the present invention, there has been no offshore support structure for use in water depths of from approximately 300 to 600 feet which: is simple and economical to manufacture and install; does not require costly piles extending the length of the offshore support structure; has standardized, symmetrical construction; and has a smaller wave load due to a reduced surface area upon which the water acts.

Therefore, the art has sought an offshore support structure which: is simple and economical to manufacture and install; does not require costly, elongate piles which extend the length of the offshore support structure; has a smaller surface area upon which the water acts, thus reducing the wave loads; and has standardized, symmetrical component parts which promote ease and economy in manufacture and installation.

SUMMARY OF THE INVENTION

In accordance with the invention, the foregoing advantages have been achieved through the present offshore support structure for use with at least one well located in a body of water. The present invention includes: a central support structure having at least three tubular legs, each leg having upper and lower ends, the legs all having a length greater than the depth of the body of water, the upper ends of each of the legs being adapted to be disposed above the surface of the body of water, each of the at least three legs being disposed substantially parallel with each other; each leg and each leg adjacent thereto forming a set of legs, each set of legs defining an outer wall surface for the central support structure, the central support structure having at least three outer wall surfaces, all of the outer wall surfaces lying in planes which have longitudinal axes which are all substantially parallel with each other; a first set of brace members interconnecting the at least three legs; at least two outrigger support structures, each outrigger support structure having at least two tubular legs disposed substantially parallel to each other and to the tubular legs of the central support structure, each leg of each outrigger support structure having a length which is substantially less than the depth of the body of water; a second set of brace members connecting the legs of each outrigger support structure in a spaced relationship from each other and from the lower ends of a set of tubular legs of the central support structure; at least one pile associated with each of the legs of each outrigger support structure; the legs of each outrigger support structure and a set of legs of the central support structure associated therewith defining a plurality of outrigger support structure outer wall surfaces; a platform structure secured to the upper ends of each leg of the central support structure; and the central support structure having a base area defined by the area bounded by the at least three outer wall surfaces of the central support structure, each of the at least two outrigger support structures having a base area defined by the area disposed within the outrigger support structure outer wall surfaces, the total base area of the at least two outrigger support structures being substantially greater than the base area of the central support structure.

Another feature of the present invention is that the offshore support structure may have no piles passing through any of the at least three tubular legs of the central support structure. A further feature of the present invention is that substantially all of the first set of brace members interconnecting the at least three legs of the central suppport structure lie in the planes formed by the central support structure outer wall surfaces. An additional feature of the present invention is that the piles associated with each of the legs of the outrigger support structure may pass through each of the legs.

Another feature of the present invention is that the piles associated with each of the legs of the outrigger support structure may be disposed in pile guides associated with each of the legs. A further feature of the present invention is that a pile may be associated with the lower end of each of the tubular legs of the central support structure. Another feature of the present invention is that a pile may be disposed in a pile guide associated with the lower end of each of the tubular legs of the central support structure.

An additional feature of the present invention is that the central support structure may have four tubular legs and three outrigger support structures may be connected to the central support structure. A further feature of the present invention is that at least one well may be disposed between the outer wall surfaces of the central support structure, and the at least one well extends to the platform structure. Another feature of the present invention is that each leg of each outrigger support structure may have substantially the same length.

The offshore support structure for use with at least one well located in a body of water of the present invention, when compared with previously proposed prior art offshore structures has the advantages of: being simple and economical to manufacture and install; does not require costly, elongate piles extending the length of the offshore support structure; utilizes standardized lengths of materials to construct the offshore support structure: being symmetrical to permit simple and economical manufacturing; presents a smaller surface area upon which the water acts, whereby there are smaller wave loads on the structure; and permits the offshore support structure to be constructed from smaller size components, thus making the offshore support structure more economical to manufacture.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

With reference to FIGS. 1-5, an offshore support structure 60 in accordance with the present invention is shown for use with at least one well 61 located in a body of water 62. Support structure 60 generally comprises a central support structure 63 and at least two outrigger support structures, or pile load transfer frames, 64.

Figure 1:
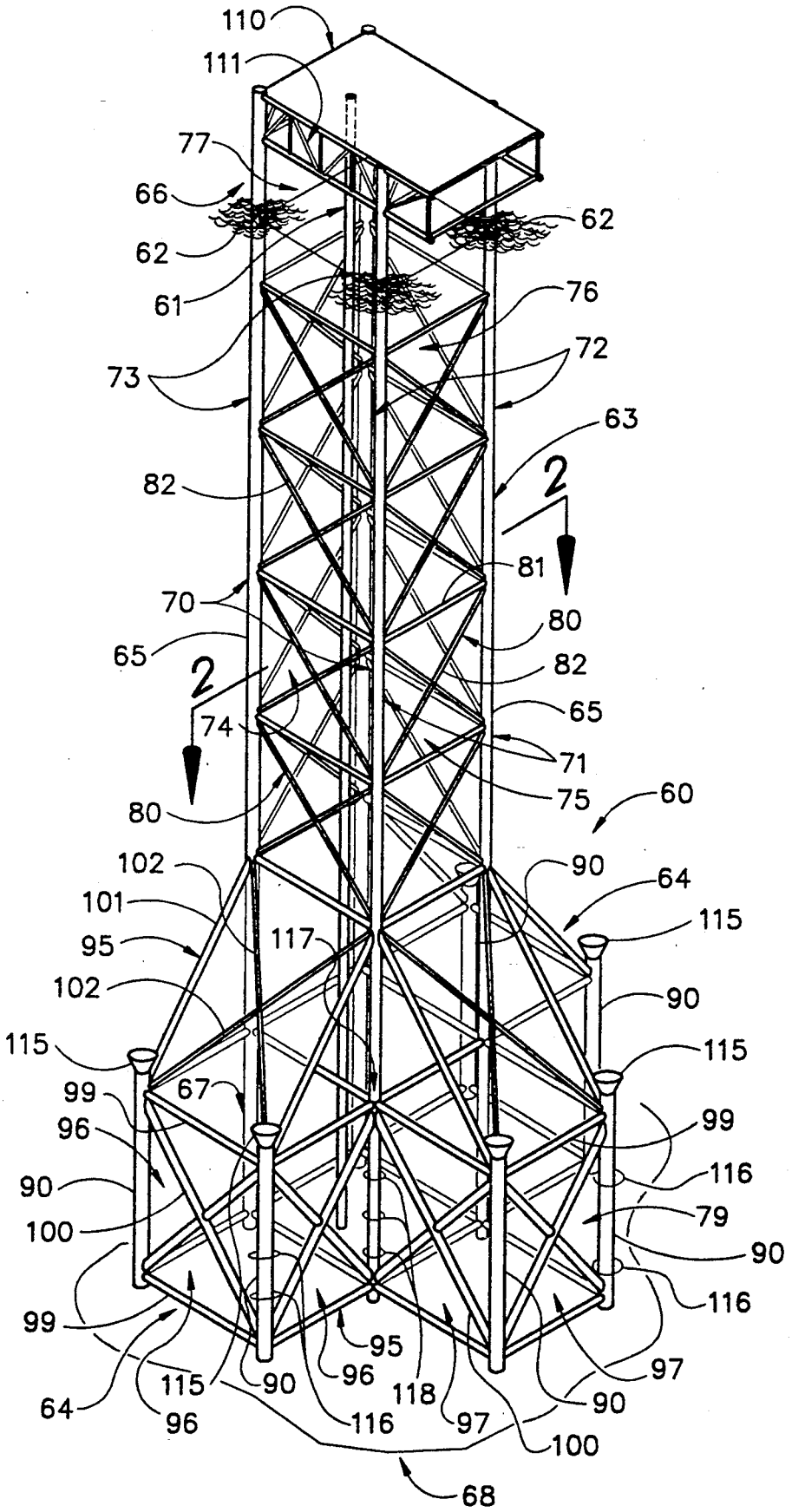
FIG. 1 is a perspective view of an offshore support structure in accordance with the present invention.

The central support structure generally comprises at least three tubular legs 65, four tubular legs 65 being illustrated in the embodiment of offshore support structure 60 in FIG. 1. Each leg 65 has upper and lower ends 66, 67, the legs 65 all having a length greater than the depth of the body of water 62. As seen in FIGS. 1, and 3-5, the upper ends 66 of each of the legs 65 are adapted to be disposed above the surface of the body of water 62. Each of the at least three legs 65 are disposed substantially parallel with each other. By use of the term "substantially parallel" is meant that legs 65 are intended to be disposed substantially parallel to each other and substantially perpendicular to the surface 68 underlying body of water 62, although there might be some slight angular tolerance due to variances in the surface 68 underlying body of water 62. Use of the term "substantially parallel", in connection with tubular legs 65, specifically excludes leg 65 being "battered" or sloping upwardly and inwardly as found in conventional offshore support structures. In the embodiment of offshore support structure 60 illustrated in FIGS. 1-5, central support structure 63 generally has a rectangular, columnar configuration.

Figure 6:
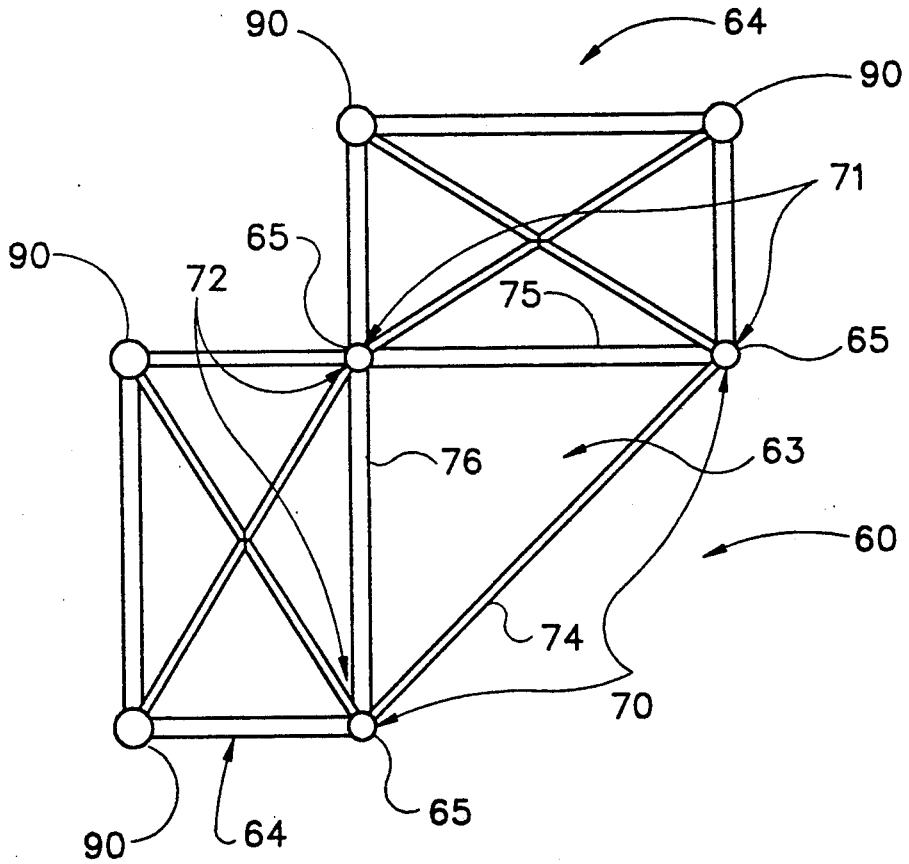
FIG. 6 is a cross-sectional view of another embodiment of the offshore support structure of FIG. 1, this view being similar to FIG. 2.

Still with reference to FIGS. 1-5, each leg 65 and each leg 65 adjacent thereto form a set of legs, four sets 70-73 of legs 65 being present in the embodiment of offshore support structure 60 illustrated in FIG. 1. Each set 70-73 of legs 65 defines an outer wall surface, four outer wall surfaces 74-77 being illustrated in the embodiment of offshore support structure 60 of FIG. 1. Central support structure 63 preferably has at least three outer wall surfaces. In the embodiment illustrated in FIGS. 1-5, there are four outer wall surfaces 74-77. As will be hereinafter described in greater detail, in another embodiment of the offshore support structure 60 of the present invention, as illustrated in FIG. 6, there are three outer wall surfaces. As seen in FIGS. 1-5, all of the outer wall surfaces 74-77 lie in planes which have longitudinal axes which are all substantially parallel with each other, which are in turn substantially parallel with each of the at least three tubular legs 65.

A first set of brace members 80 interconnects the at least three legs 65. The first set of brace members 80 preferably includes a plurality of horizontally disposed tubular brace members 81, and a plurality of diagonally disposed tubular brace members 82. It should of course be readily apparent to one of ordinary skill in the art that the first set of brace members 80, including brace members 81, 82 may have a tubular configuration, or any other suitable configuration, provided they have the requisite strength characteristics to provide the necessary bracing and interconnection of legs 65. Because of the symmetrical design of central support structure 63, including the perpendicularity of horizontal braces 81 with respect to legs 65, each of the horizontal braces 81 can be fabricated in the same size, as can the diagonal braces 82. Accordingly, fabrication costs for the first set of brace members 80 can be minimized because of the standardized size. Additionally, because of the rectangular, columnar configuration of central support structure 63, fabrication and manufacturing costs can be also minimized, due to the fact that no angular variations must be measured and laid out when fabricating central support structure 63. Preferably, substantially all the first set of brace members 80, including horizontal and diagonal brace members 81, 82, lie in the planes formed by the central support structure outer wall surfaces 74–77. If desired, additional bracing, such as braces 85, 86 may be utilized, which braces 85, 86, extend between oppositely disposed legs 65 as seen in FIG. 2.

Still with reference to FIGS. 1–5, offshore support structure 60 preferably includes at least two outrigger support structures, or pile load transfer frames, 64. Each outrigger support structure 64 has at least two tubular legs 90, which preferably are disposed substantially parallel to each other and to the tubular legs 65 of the central support structure 63. Each leg 90 of each outrigger support structure 64 has a length which is substantially less than the depth of the body of water 62, as seen at FIGS. 1 and 3–5. Preferably, each leg 90 of each outrigger support structure 64 has substantially the same length.

A second set of brace members 95 is provided to connect the legs 90 of each outrigger support structure 64 in a spaced relationship from each other and from the lower ends 67 of a set 70–73 of tubular legs 65 of the central support structure 63. As will be hereinafter described in greater detail, at least one pile may be associated with each of the legs 90 of each outrigger support structure 64. In the embodiment of offshore support structure 60 illustrated in FIGS. 1–5, preferably three outrigger support structures 64 are provided. As will be hereinafter described in greater detail, in the embodiment of outrigger support structure 60 illustrated in FIGS. 6, two outrigger support structure 64 are provided.

Figure 2:
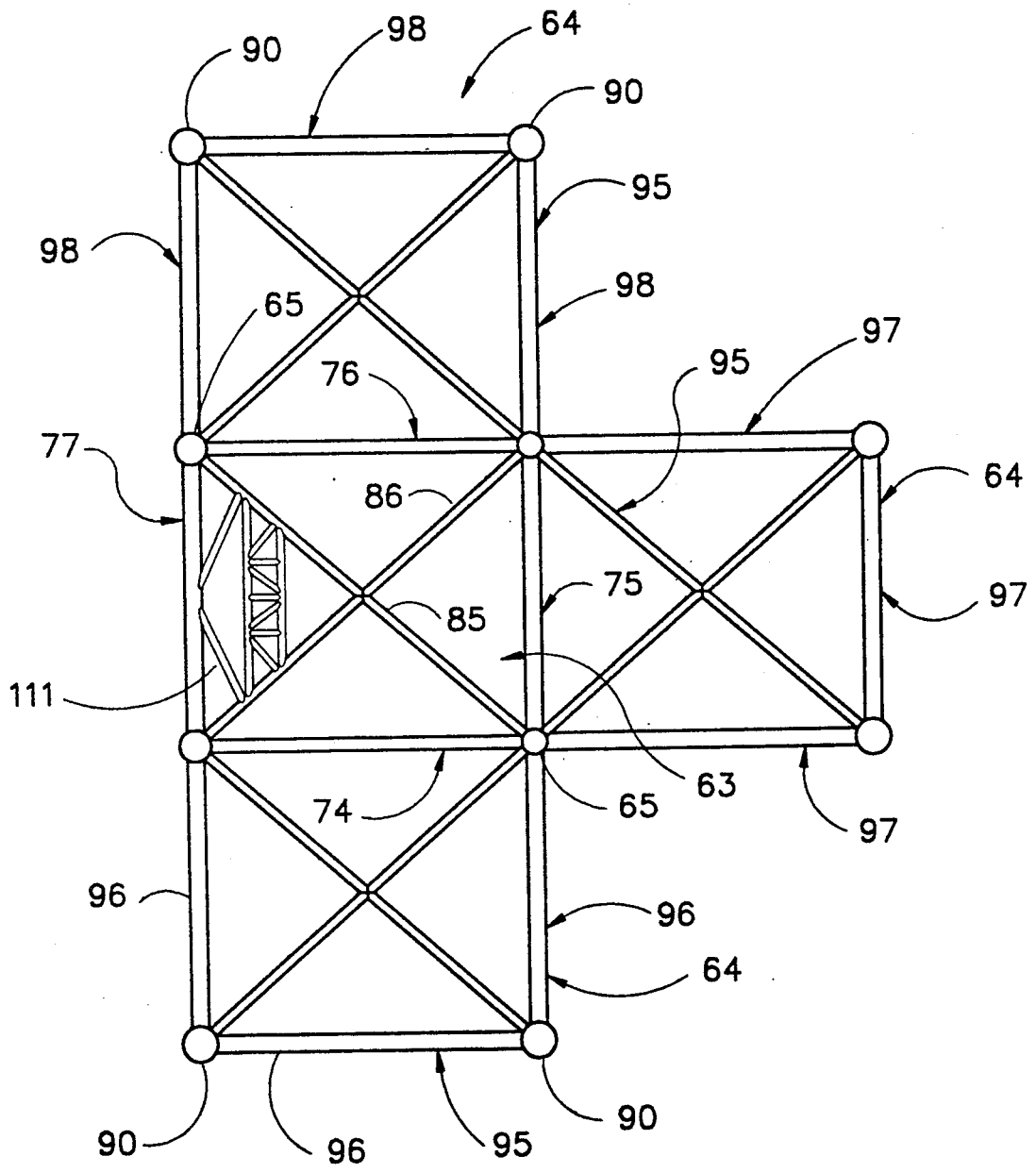
FIG. 2 is a cross sectional view taken along lines 2—2 of FIG. 1.
Figure 3:
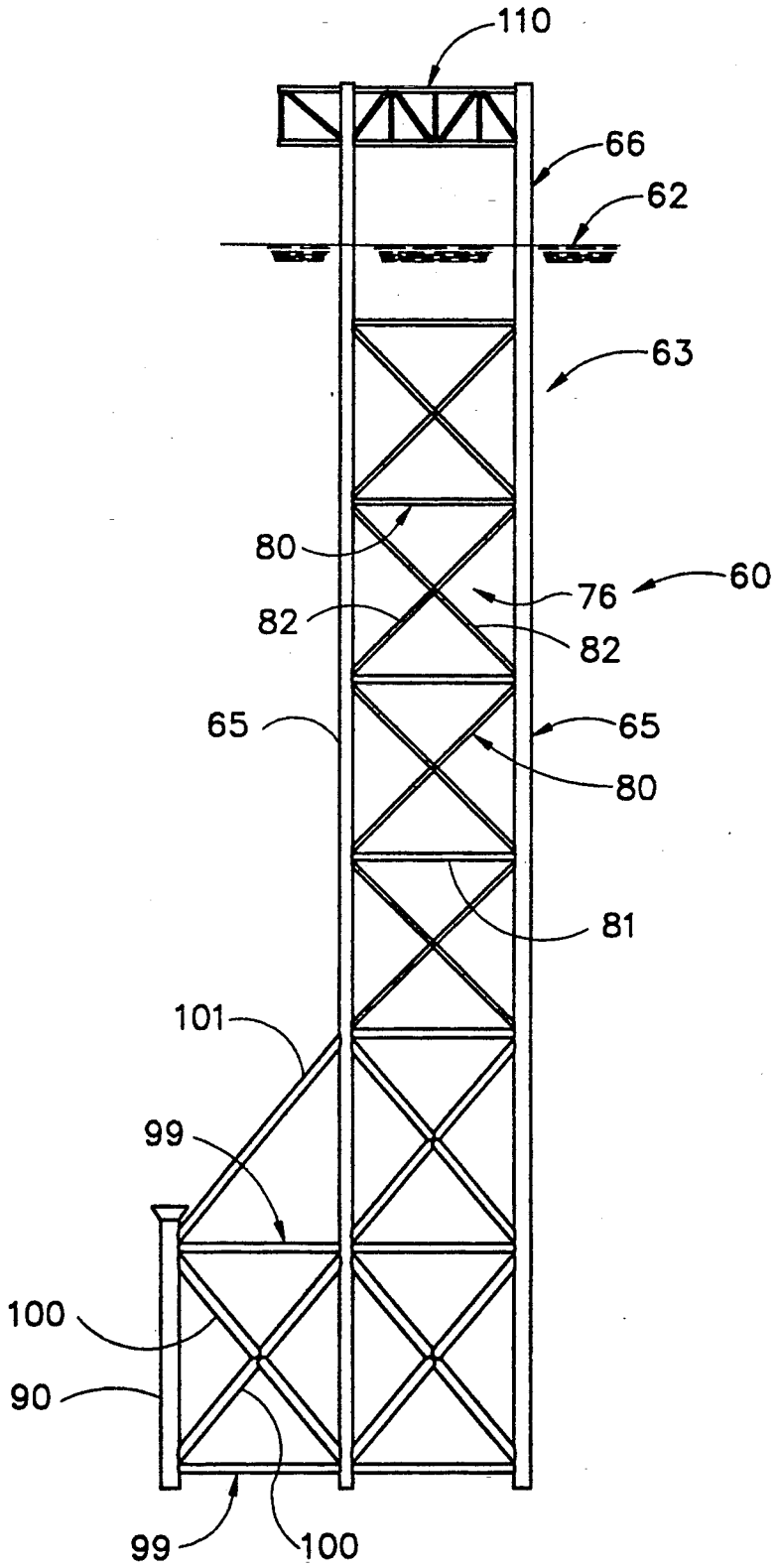
FIG. 3 is a side view of the offshore support structure of FIG. 1.
Figure 4:
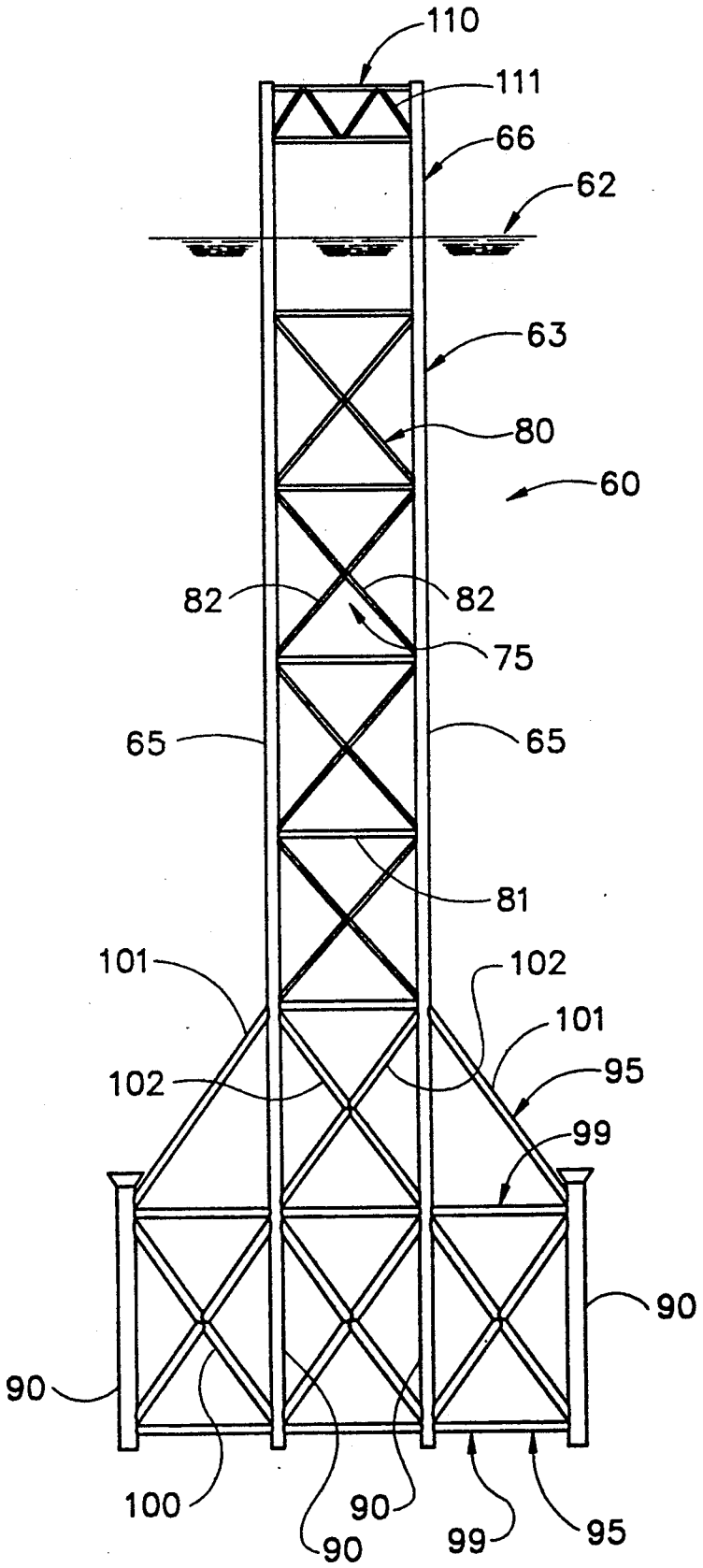
FIG. 4 is a front view of the offshore support structure of FIG. 1.
Figure 5:
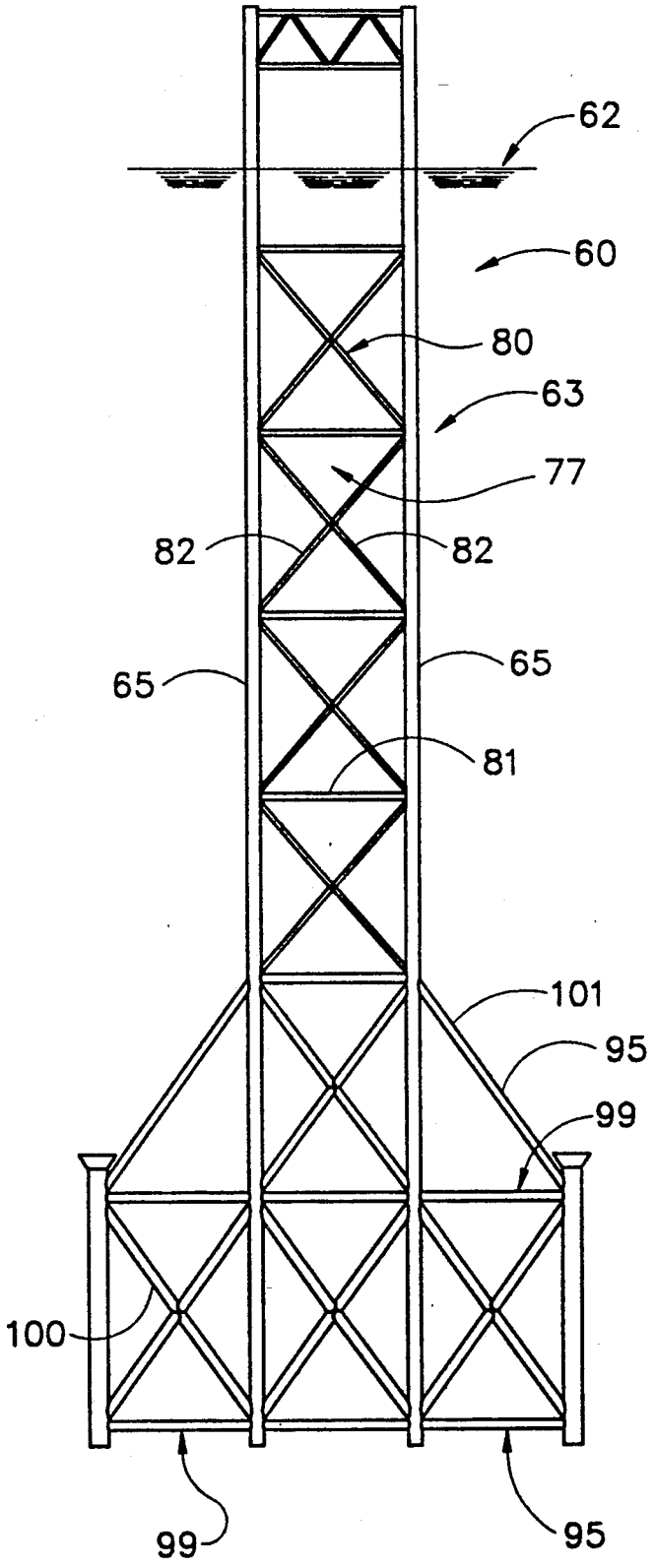
FIG. 5 is a rear view of the offshore support structure of FIG. 1.

Still with reference to FIGS. 1–5, the legs 90 of each outrigger support structure 64 and a set 70–73 of legs 65 of the central support structure 63 define a plurality of outrigger support structure outer wall surfaces 96–98, three outrigger support structure outer wall surfaces being associated with the legs 90 of each outrigger support structure 64, as seen in FIG. 2. The second set of brace members 95 preferably includes a plurality of horizontal brace members 99 extending between tubular legs 90 and the set 70–73 of legs 65 associated with each outrigger support structure 64. Additionally, a plurality of diagonal braces 100 extend between legs 90 and a set 70–73 of legs 65 associated with each outrigger support structure 64. The second set of brace members 95 also include a plurality of brace members 101 which extend from the upper end of legs 90 to legs 65, and a plurality of diagonal brace members 102 which extend from the upper end of legs 90 to oppositely disposed legs 65 of central support structure 63 as seen in FIGS. 1 and 4. Preferably, horizontal and diagonal brace members 99, 100, lie in the same plane as the outrigger support structure outer wall surfaces 96–98, with which they are associated.

Still with reference to FIGS. 1–5, a platform structure 110 may be secured to the upper ends 66 of each leg 65 of the central support structure 63. Platform structure 110 may include conventional bracing 111 to provide the requisite strength and rigidity for platform structure 110, in a conventional manner.

As best seen in FIG. 2, central support structure 63 has a base area defined by the area bounded by the at least three outer wall surfaces 74–77 of the central support structure 63 which base area, in the embodiment of offshore support structure 60 illustrated in FIGS. 1–5, has a generally rectangular configuration. Likewise, each of the at least two outrigger support structures 64, three of such outrigger support structures 64 being illustrated in the embodiment of offshore support structure 60 of FIG. 2, has a base area defined by the area disposed within the outrigger support structure outer wall surfaces 96–98. As seen in FIG. 2, the total base area of the at least two outrigger support structures 64 is substantially greater than the base area of the central support structure 63. The combined base area of the outrigger support structure 64 and the central support structure 63 thus provide a substantial base, foundation, or platform "footprint", to support the central support structure 63. This wide, enlarged base area, or "footprint" of offshore support structure 60 provides stability to central support structure 63, while at the same time permits central support structure 63 to be fabricated as a relatively narrow columnar configuration, without the necessity to use "battered" legs.

As seen in FIG. 1, at least one pile 115 is associated with each of the legs 90 of the outrigger support structures 64. Preferably, piles 115 pass through each of the legs 90, in order to secure the offshore support structure 60 to the surface 68 underlying body of water 62. Alternatively, piles 115 may be disposed in pile guides 116 associated with each of the legs 90. Alternatively, if desired, a pile 115 may pass through leg 90, and additional piles 115 may also be associated with legs 90 of outrigger support structures 64 and pile guides 116.

Additionally, a pile 117 may be associated with the lower end 67 of each of the tubular legs 65 of the central support structure 63, one such pile 117 being illustrated in FIG. 1. Preferably, piles 117 are disposed in pile guides, or sleeves, 118 associated and connected with the lower end 67 of each of the tubular legs 65 of the central support structure 63. It should be noted that with the design of offshore support structure 60 illustrated and described herein, it is not necessary for piles to be passed through any of the at least three tubular legs 65 of the central support structure 63, which piles extend from the upper end 66 to the lower end 67 of legs 65. Alternatively, if desired, such additional piling could be utilized; however, it is believed that such piling would not be necessary. Because of the wider, or enlarged base, foundation, or "footprint" of offshore support structure 60, as previously described, axial loads in piles 115 and 117 are reduced because of the enlarged, widened foundation, or base area, of offshore support structure 60, in contrast to the smaller and narrower cross-sectional configuration of central support structure 63. Accordingly, less penetration of piles 115 and 117 into the surface 68 below body of water 62 is necessary, whereby installation of offshore structure 60 is quicker and less expensive than installation procedures for other prior art offshore support structures.

With reference now to FIG. 6, another embodiment of the offshore support structure 60, in accordance with the present invention, is illustrated. In the embodiment illustrated in FIG. 6, offshore support structure 60 has three tubular legs 65 and two outrigger support structures 64 associated therewith. As with the embodiment of offshore support structure 60 illustrated in connection with FIGS. 1–5, each leg 65 and each leg adjacent thereto, form a set of legs 70–72, each set of legs 70–72 defining an outer wall surface 74–76 for the central support structure 63. All the outer wall surfaces 74–76 likewise lie in planes which have longitudinal axes which are all substantially parallel with each other. The same sets of brace members 80, 95 are utilized in the embodiment of offshore support structure 60 of FIG. 6, and the outrigger support structures 64 are constructed in the same manner. Alternatively, if desired, an additional outrigger support structure 64 could be provided and associated with outer wall surface 74 for the central support structure 63.

The installation of offshore support structure 60 can be relatively easily accomplished as by: launching offshore support structure 60 from a conventional barge; floating offshore support structure 60 for a period of time; and then flooding portions of offshore support structure 60, so as to cause it to land upon surface 68 beneath body of water 62 in the position shown in FIG. 1. After offshore support structure 60 is resting upon surface 68, as illustrated in FIG. 1, piles 115 and/or 117 may be stabbed through legs 90 and/or pile guide sleeves 116 and/or 118, in a conventional manner. Alternatively, offshore support structure 60 can be floated to its desired location in body of water 62, without utilizing a barge, and following subsequent installation steps as those previously described. Preferably, wells 61 are disposed within conventional conductors extending from surface 68 to platform structure 110, the wells being disposed within such conductors, in a conventional manner.

It is to be understood that the invention is not limited to the exact details of construction, operation, exact materials or embodiment shown and described, as obvious modifications and equivalents will be apparent to one skilled in the art; for example, different bracing member configurations could be utilized, or the support structure could be used without a well, or five substantially parallel legs could be utilized for the central support structure. Accordingly, the invention is therefore to be limited only by the scope of the appended claims.

I claim:

1. An offshore support structure for use with at least one well located in a body of water, comprising:

a central support structure having at least three tubular legs, each leg having upper and lower ends, the legs all having a length greater than the depth of the body of water, and the upper ends of each of the legs are adapted to be disposed above the surface of the body of water, each of the at least three legs being disposed substantially parallel with each other; each leg and each leg adjacent thereto forming a set of legs, each set of legs defining an outer wall surface of the central support structure, the central support structure having at least three outer wall surfaces, all of the outer wall surfaces lying in planes which have longitudinal axes which are all substantially parallel with each other; and a first set of brace members interconnecting the at least three legs;

at least two, but not more than three, outrigger support structures, each outrigger support structure having at least two tubular legs disposed substantially parallel to each other and to the tubular legs of the central support structure, each leg of each outrigger support structure having a length which is substantially less than the depth of the body of water; a second set of brace members connecting the legs of each outrigger support structure in a spaced relationship from each other and from the lower ends of a set of tubular legs of the central support structure; at least one pile associated with and disposed substantially parallel with, each of the legs of each outrigger support structure; the legs of each outrigger support structure and a set of legs of the central support structure associated therewith defining a plurality of outrigger support structure outer wall surfaces;

a platform structure secured to the upper ends of each leg of the central support structure; and the central support structure having a base area defined by the area bounded by the at least three outer wall surfaces of the central support structure, each of the outrigger support structures having a base area defined by the area disposed within the outrigger support structure outer wall surfaces, the total base area of the at least two outrigger support structures being substantially greater than the base area of the central support structure.

2. The offshore support structure of claim 1, wherein no piles pass through any of the at least three tubular legs of the central support structure.

3. The offshore support structure of claim 1, wherein substantially all of the first set of brace members interconnecting the at least three legs of the central support structure lie in the planes formed by the central support structure outer wall surface.

4. The offshore support structure of claim 1, wherein the piles associated with each of the legs of the outrigger support structure pass through each of the legs.

5. The offshore support structure of claim 1, wherein the piles associated with each of the legs of the outrigger support structure are disposed in pile guides associated with each of the legs.

6. The offshore support structure of claim 1, wherein a pile is associated with the lower end of each of the tubular legs of the central support structure.

7. The offshore support structure of claim 6, wherein a pile is disposed in a pile guide associated with the lower end of each of the tubular legs of the central support structure.

8. The offshore support structure of claim 1, wherein the central support structure has four tubular legs and three outrigger support structures are connected to the central support structure.

9. The offshore support structure of claim 1, wherein at least one well is disposed between the outer wall surfaces of the central support structure and the at least one well extends to the platform structure.

10. The offshore support structure of claim 1, wherein each leg of each outrigger support structure has substantially the same length.

* * * * *